US006972514B2

(12) United States Patent
Itaya et al.

(10) Patent No.: US 6,972,514 B2
(45) Date of Patent: Dec. 6, 2005

(54) LOW-PRESSURE MERCURY VAPOR DISCHARGE LAMP WITH IMPROVED HEAT DISSIPATION, AND MANUFACTURING METHOD THEREFORE

(75) Inventors: Kenji Itaya, Takatsuki (JP); Takeshi Matsumura, Kashiwara (JP); Yoshinori Kakuno, Katano (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 50 days.

(21) Appl. No.: 10/247,125

(22) Filed: Sep. 19, 2002

(65) Prior Publication Data

US 2003/0071556 A1 Apr. 17, 2003

(30) Foreign Application Priority Data

Oct. 3, 2001 (JP) ..... 2001-307587

(51) Int. Cl.[7] ..... H01J 5/48; H01J 5/50; H01J 5/54

(52) U.S. Cl. ..... 313/318.01; 313/317; 313/318.08; 313/318.12; 313/17; 313/22; 313/36; 439/226; 439/611; 439/613; 439/618

(58) Field of Search ..... 313/318.01, 318.08, 313/318.09, 17, 22, 25, 26, 36; 439/226, 618, 611, 613

(56) References Cited

U.S. PATENT DOCUMENTS

| | | | | |
|---|---|---|---|---|
| 4,681,794 A | | 7/1987 | Kunert et al. | |
| 4,745,323 A | | 5/1988 | Northrop et al. | |
| 5,629,586 A | * | 5/1997 | Yasuda et al. | 313/344 |
| 5,806,971 A | * | 9/1998 | Sugihara et al. | 313/318.08 |

FOREIGN PATENT DOCUMENTS

| | | |
|---|---|---|
| JP | 57063764 A | 4/1982 |
| JP | 62-074470 | 4/1987 |
| JP | 03-245401 | 11/1991 |
| JP | 06342642 A | 12/1994 |
| JP | 07-073714 | 3/1995 |
| JP | 09-153341 | 6/1997 |

* cited by examiner

*Primary Examiner*—Mariceli Santiago

(57) ABSTRACT

A bulb-type fluorescent lamp has a case having an open end portion for housing a lighting circuit therein, an arc tube extending outside through the open end portion of the case, and a globe having an open end portion for housing the arc tube therein. An adhesive is supplied to the inner surface of the open end portion of the case at four circumferentially spaced areas, and the open end portion of the globe is inserted into the open end portion of the case. As a result, the globe is fixed to the case with the adhesive.

17 Claims, 11 Drawing Sheets

2
3
4
5
6
6c
7
12
14
15
16
17
5a
5c

LOW-PRESSURE MERCURY VAPOR DISCHARGE LAMP WITH IMPROVED HEAT DISSIPATION, AND MANUFACTURING METHOD THEREFORE

This application is based on an application No. 2001-307587 filed in Japan, the content of which is hereby incorporated by reference.

BACKGROUND OF THE INVENTION (1) Field of the Invention

The present invention relates to a low-pressure mercury vapor discharge lamp provided with a globe housing an arc tube therein, and to a manufacturing method therefore. Especially, the present invention relates to a bulb-type fluorescent lamp.

(2) Description of the Related Art

A bulb-type fluorescent lamp, which is one type of a low-pressure mercury vapor discharge lamp, has higher luminance efficacy and a longer life in comparison with a filament lamp. Due to these advantages, a bulb type fluorescent lamp is recognized as an energy-saving lighting apparatus, and thus rapidly becoming prevalent.

FIG. 1 shows a partly-broken, vertical sectional view showing the construction of a conventional bulb-type fluorescent lamp. As shown in the figure, the bulb-type fluorescent lamp 51 is composed of a serpentine arc tube 53, a holder 54 for holding the arc tube 53, a lighting circuit 57 being arranged on the opposite side of the holder 54 to the arc tube 53, a case 55 for housing the lighting circuit 57 therein, and a globe 52 mounted to the case 55 in a manner to cover the arc tube 53 therein.

As shown in FIG. 2, an open end portion 52*a* of the globe 52 is loosely inserted into an open end portion 55*a* of the case 55. The globe 52 is fixed to the case 55 with the adhesive 56 that is supplied entirely along the inner periphery of the open end portion 55*a* of the case 55. Here, the adhesive 56 is supplied through a single supply nozzle to the open end portion 55*a*. To be more specific, while the adhesive 56 is supplied through the supply nozzle that is fixed at one location, the case 55 is rotated one full turn in the circumferential direction. With this arrangement, the adhesive 56 is supplied entirely along the inner periphery of the open end portion 55*a* of the case 55.

The conventional bulb-type fluorescent lamp 51, however, has the following problem: That is, heat generated by the arc tube 53 during light emission is conducted to the case 55 through the adhesive 56 supplied along the entire periphery of the open end portion 52*a* of the globe 52. As a result, the surrounding temperature of the lighting circuit 57 housed in the case 55 rises significantly. Being exposed to such a high temperature, components constituting the lighting circuit 57 become less reliable, if not damaged.

Another problem lies in the manufacturing method. In the conventional method, the case 55 must be rotated one full turn in order to supply the adhesive 56 entirely along the inner periphery of the open end portion 55*a*. Such a supplying process is time consuming, and thus undesirably reduces productivity in manufacturing such fluorescent lamps.

SUMMARY OF THE INVENTION

A first object of the present invention is to provide a low-pressure mercury vapor fluorescent lamp capable of preventing temperature rise at a surrounding portion of the lighting circuit. A second object of the present invention is to provide a method for manufacturing a low-pressure mercury vapor fluorescent lamp with enhanced productivity.

The above-stated first object of the present invention is achieved by a low-pressure mercury vapor discharge lamp that has: an envelope formed of a case and a globe each having an open end, the case and the globe being loosely fitted together by inserting one open end into the other; an arc tube covered by the globe; and a lighting circuit housed in the case. Here, the case and the globe are partially bonded to each other along a circumferential surface of where the case and the globe overlap as the result of insertion. With this arrangement, in the overlapping surface of the case and the globe, there remains an area that the case and the globe are not bonded in the circumferential direction. Air present in the non-bonded area functions as heat insulator, so that heat generated by the arc tube is prevented from being conducted from the globe to the case. In addition, the heat generated from the arc tube is released outside through the non-bonded area. As a consequence, temperature rise in the envelope is prevented. That is to say, temperature rise around the lighting circuit housed in the envelope is suppressed, so that the circuit components are kept from being damaged and remain reliable.

Further, the second object of the present invention sated above is achieved by a method for manufacturing a low-pressure mercury vapor lamp provided with a globe attached to a case so as to house an arc tube therein. The method includes: a sticking agent supplying step of supplying a sticking agent to the case in an area of a circumferential surface of an open end portion to be attached to the globe; and a fitting step of loosely fitting together an open end portion of the globe and the open end portion of the case so that the globe overlaps the area of the case where the sticking agent is supplied. With this method, in contrast to a conventional method in which the sticking agent is supplied along the entire periphery of the open end portion of the case, the area to which the sticking agent is supplied is smaller, so that the time taken to supply the sticking agent is shortened. In addition, the usage amount of sticking agent is made smaller in comparison with the conventional method, which leads to that the cost of the sticking agent is reduced.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

Now, description is given to one embodiment in which the present invention is applied to a bulb-type fluorescent lamp with reference to the accompanying drawings.

Figure 1:
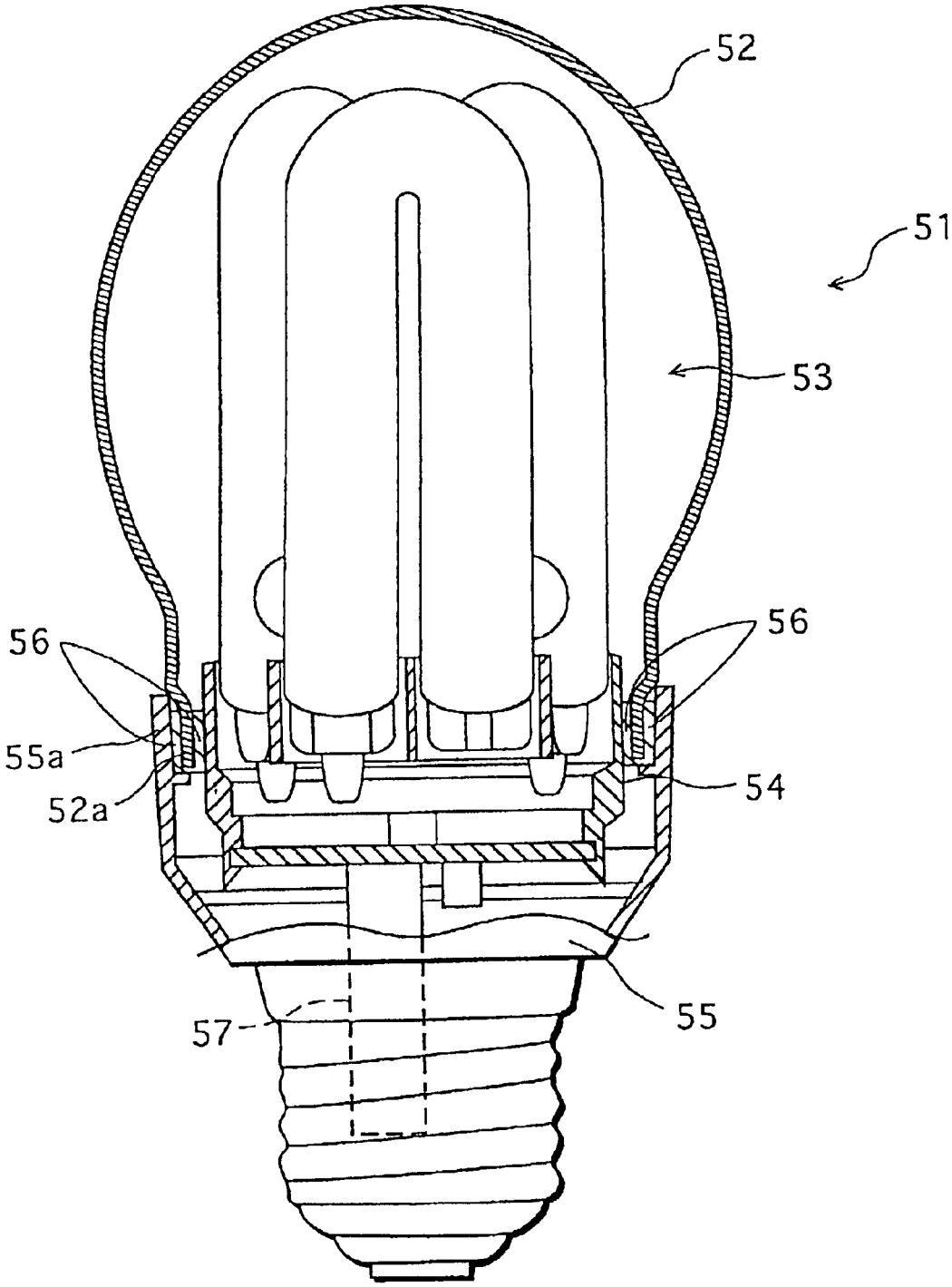
FIG. 1 is a vertical sectional view showing a conventional bulb-type fluorescent lamp.
Figure 2:
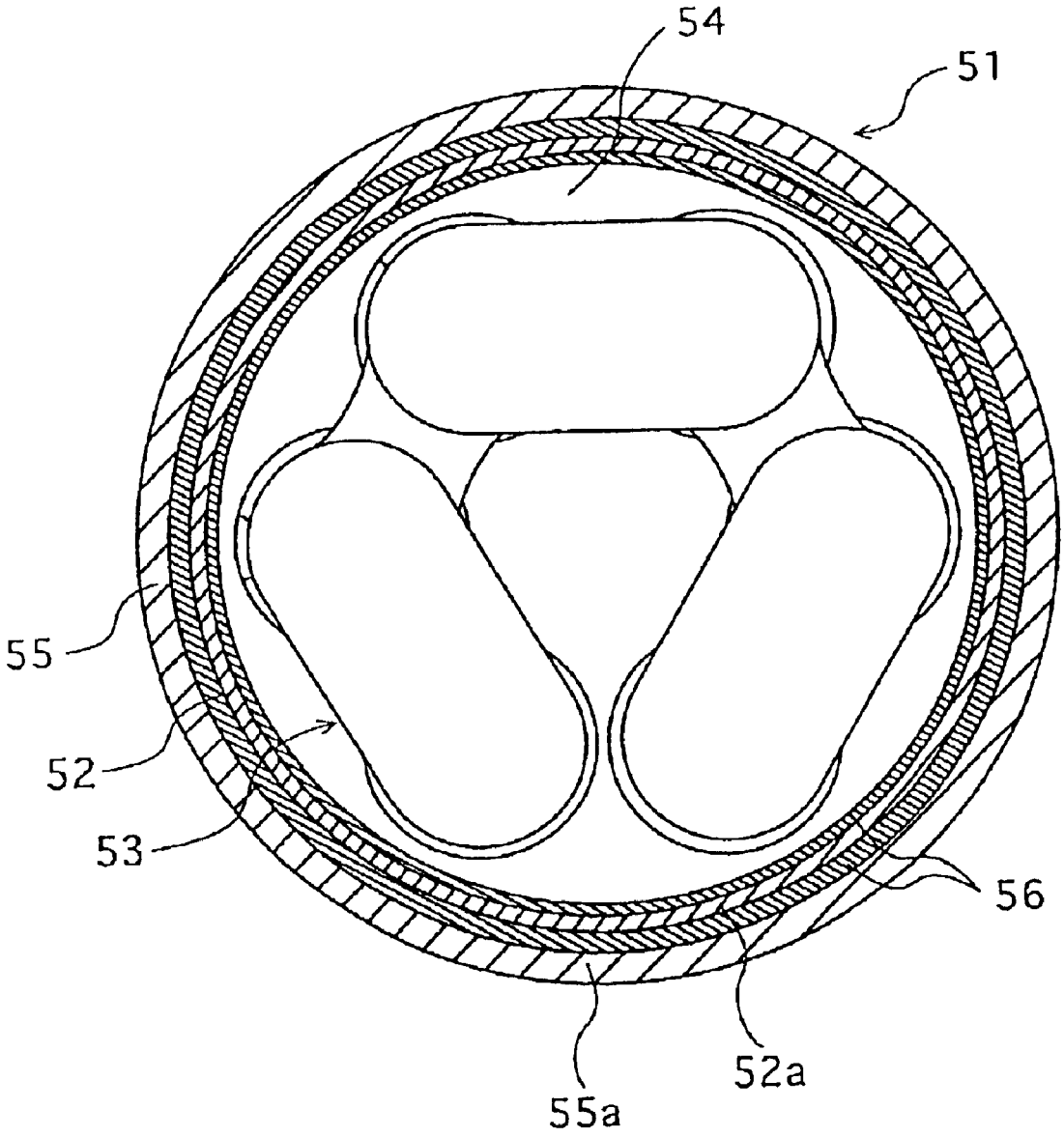
FIG. 2 is a plan sectional view taken along a line passing through a bonded portion of a globe and a case of the conventional bulb-type fluorescent lamp.
Figure 3:
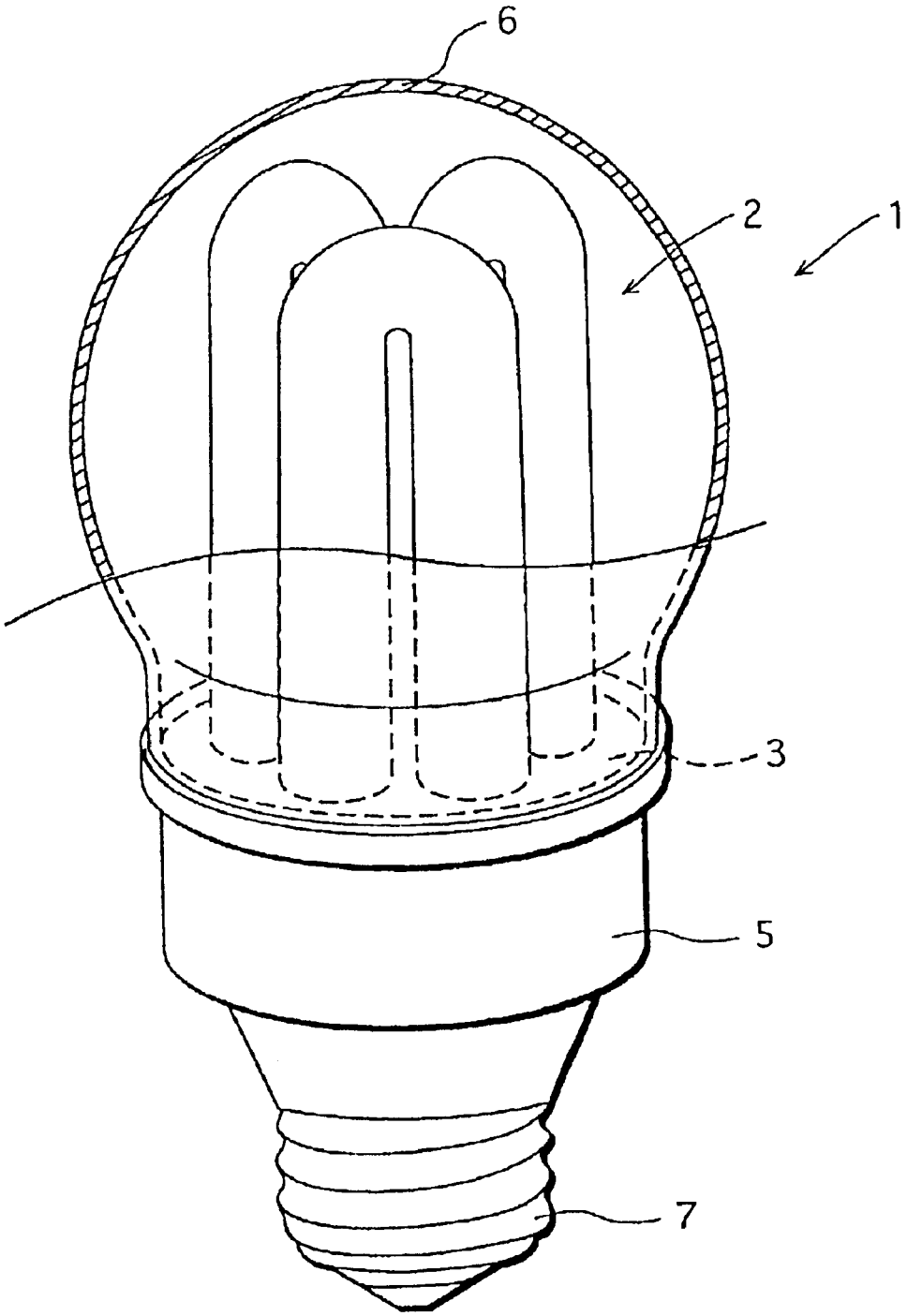
FIG. 3 is a partly-broken, oblique view showing a bulb-type fluorescent lamp according to an embodiment of the present invention.

1. Construction of Bulb-Type Fluorescent Lamp FIG. 3 is a partly-broken, oblique view showing a bulb-type fluorescent lamp. As shown in the figure, the bulb-type fluorescent lamp 1 is composed of: an arc tube 2 forming a serpentine discharge path; a holder 3 holding the arc tube 2; a lighting circuit 4 for lighting the arc tube 2, arranged on the opposite side of the holder 3 to the arc tube 2 (see FIG. 4); a case 5 housing the lighting circuit 4 therein; and a transparent globe 6 fixedly attached to the case 5 with an adhesive 14 (see FIG. 4) in a manner to cover the arc tube 2.

The case 5 and the globe 6 each has an open end portion, and are loosely fitted together at their respective open end portions with a circumferential clearance therebetween, thereby forming an envelope. The case 5 is also provided with a base 7 mounted at an end opposite to the holder 3 (i.e. at a bottom end of the case 5). The base 7 is made of metal and used to supply power to the lighting circuit 4. Note that the portion where the globe 6 and the case 5 are bonded to each other with the adhesive 14 is hereinafter referred to as a "bonded portion."

Figure 4:
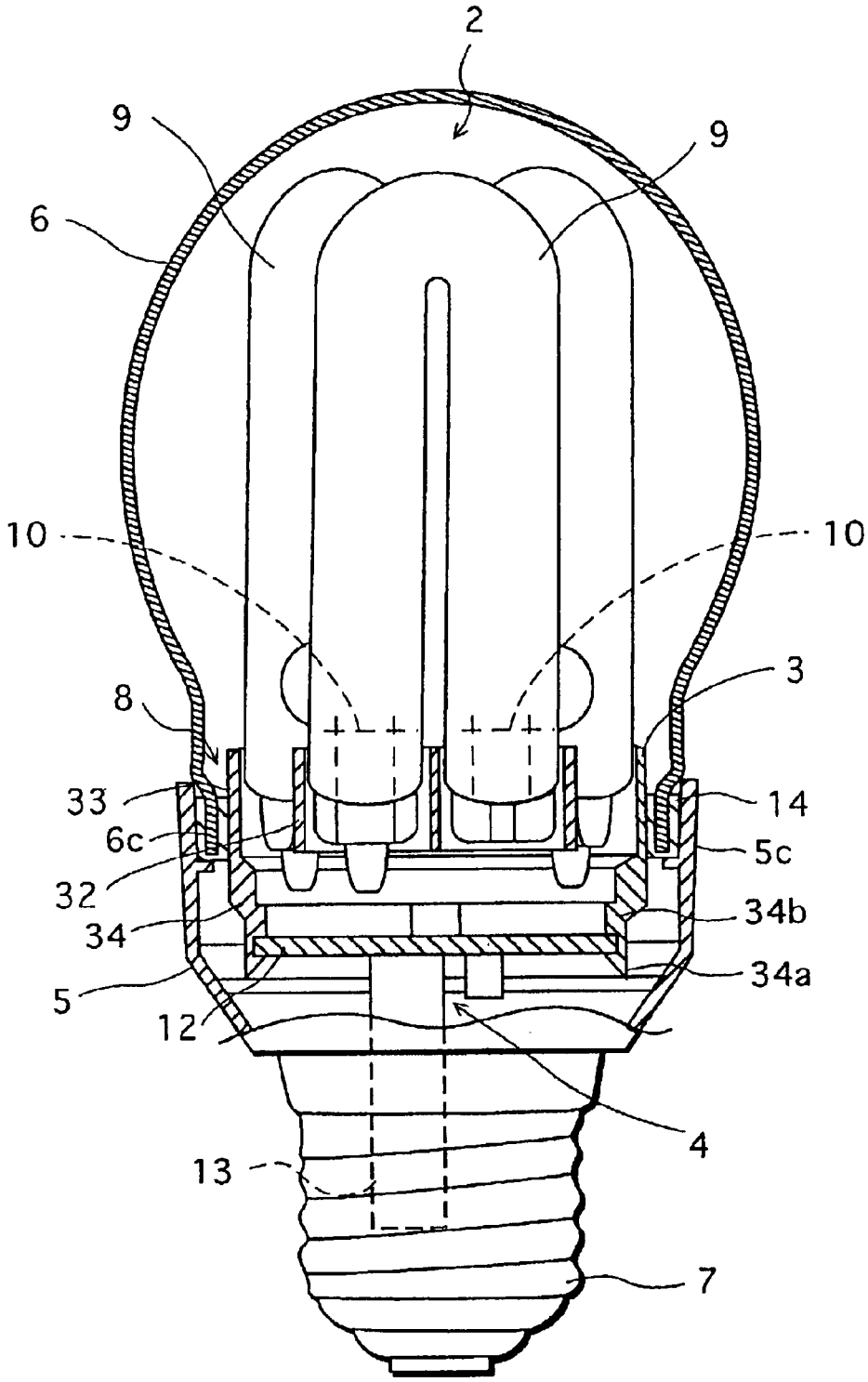
FIG. 4 is a vertical sectional view showing the bulb-type fluorescent lamp according to the embodiment of the present invention.
Figure 5:
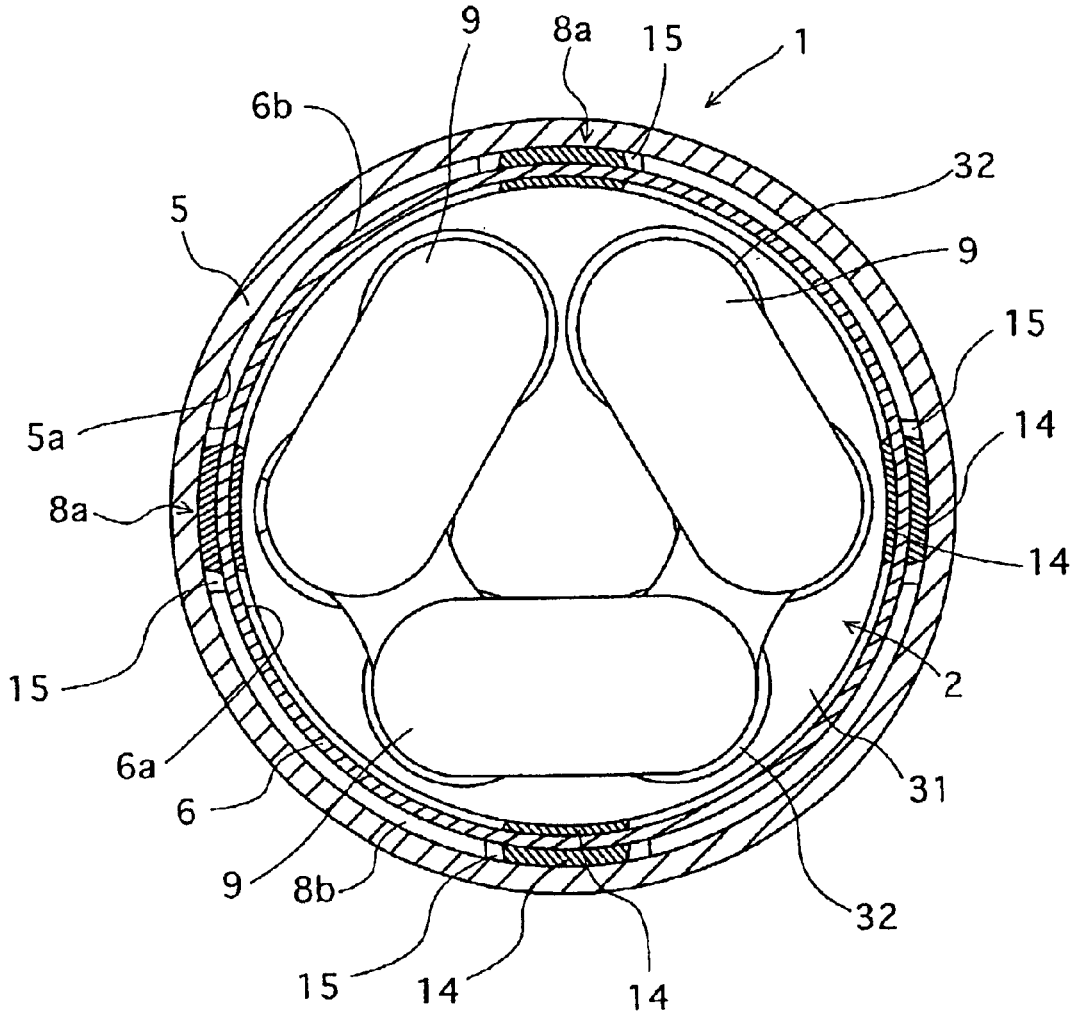
FIG. 5 is a plan sectional view taken along a line passing through a bonded portion of a globe and a case of the fluorescence lamp according to the embodiment of the present invention.

FIG. 4 is a vertical sectional view showing the bulb-type fluorescent lamp. FIG. 5 is a plan sectional view taken along a line passing through a bonded portion of the globe 6 and the case 5.

The arc tube 2 is composed of three, generally U-shaped bulbs 9. As shown in FIG. 5, each U-shaped bulb 9 is connected to a neighboring bulb by bridge connection at their respective bottom ends. Each end of the arc tube 2, i.e., the thus connected bulbs 9, is provided with an electrode 10 (see FIG. 4). With this arrangement, there is formed, through the arc tube 2, one serpentine discharge path that meanders up and down between the two electrodes 10. The inner surface of each bulb 9 is coated with a phosphor, and a noble gas and mercury are sealed within the arc tube 2.

The holder 3 has a cylindrical-shape having an upper wall 31. Formed on the upper wall 31 are six supporting members 32 for holding the arc tube 2 at locations corresponding to each end of the bulbs 9. Each supporting member 32 has a cylindrical shape with its axis extending horizontally. The bottom end of the bulb 9 inserted therein is fixed for example by an adhesive.

As shown in FIG. 4, the holder 3 is provided with a plurality of, e.g. four downwardly-extending latching arms 34 on a circumferential wall 33 thereof at locations that are equally and circumferentially spaced. The latching arms 34 latch a substrate 12 so that the substrate 12 is fixed relative to the holder 3. The substrate 12 is provided with the lighting circuit 4 attached thereto.

To be more specific, each latching arm 34 has a latching member 34*a* at the bottom end, and a positioning protrusion 34*b* along the inner surface thereof. The latching members 34*a* hold the rim of the substrate 12 from the side on which the lighting circuit 4 is provided. On the other hand, the positioning protrusions 34*b* engage against the rim of the substrate 12 from the holder 3 side. With this arrangement, the substrate 12 is attached to the holder 3.

The lighting circuit 4 is of a conventional type for illuminating the arc tube 2 by supplying power from the base 7 to the electrodes 10 that are attached to the arc tube 2. The lighting circuit 4 is mainly composed of, for example, an inverter that is made up of circuit components 13 such as a condenser, a transistor, an inductor and a resistor arranged on the substrate 12. Note that lead wires connecting the base 7 and the lighting circuit 4, and each electrode 10 of the arc tube 2 with the lighting circuit 4 are not illustrated in the figure for the simplicity sake.

The case 5 is in a cup-shape with its diameter gradually increasing toward an open end portion at the top. The open end portion is substantially circular in a plan view. As shown in FIG. 6B, when the case 5 is brought into a state of housing the lighting circuit 4 from above, each engaging member 5*b* provided on the inner surface of the case 5 engages with a protrusion 33 of the holder 3, so that the case 5 is attached to the holder 3. The case 5 may be made of a synthetic resin, such as polybutylene terephthalate (PBT). The case 5 is made of a material having an excellent heat resistance in consideration of heat generated by the arc tube 2 during light emission.

Similarly to an incandescent lamp, the globe 6 has a pear-shape (A-shape), and has a tubular portion at the bottom end thereof so as to be loosely inserted into the open end portion of the case 5 with an appropriate, circumferential clearance. The globe 6 is made of a glass material such as a soda lime glass. Alternatively, the globe 6 may be made of a transparent, synthetic resin, preferably having a high heat resistance in consideration of heat generated by the arc tube 2 during light emission. Note that the open end portion 6*c* of the globe 6 is circular in horizontal cross section similarly to that of the open end portion 5*c* of the case 5. The diameter of the open end portion 6*c* is smaller than an inner diameter of the open end portion 5*c*.

As shown in FIGS. 4 and 5, the open end portion 6*c* of the globe 6 is so fitted into the open end portion 5*c* of the case 5 that there is a circumferential clearance therebetween. The globe 6 is fixed to the case 5 with the adhesive 14 that is supplied to four, equally and circumferentially spaced areas of the open end portion 6*c*. At the time of insertion, the outer surface of the ball-shaped portion of the globe 6 comes into engagement against the rim of the open-end 5*c* so that proper positioning of the globe 6 is achieved (see FIGS. 6A and 6B). The adhesive 14 used herein is a silicon type adhesive. The adhesive 14 has an excellent heat resistance in consideration of heat generated by the arc tube 2 during light emission.

Figure 6A:
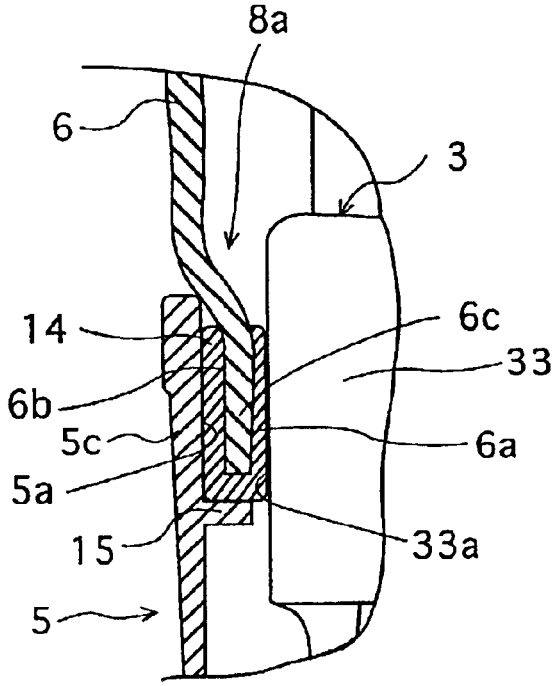
FIG. 6A is an enlarged, sectional view taken along a line passing through an overlapping portion of the globe and the case where they are bonded together with a sticking agent.
Figure 6B:
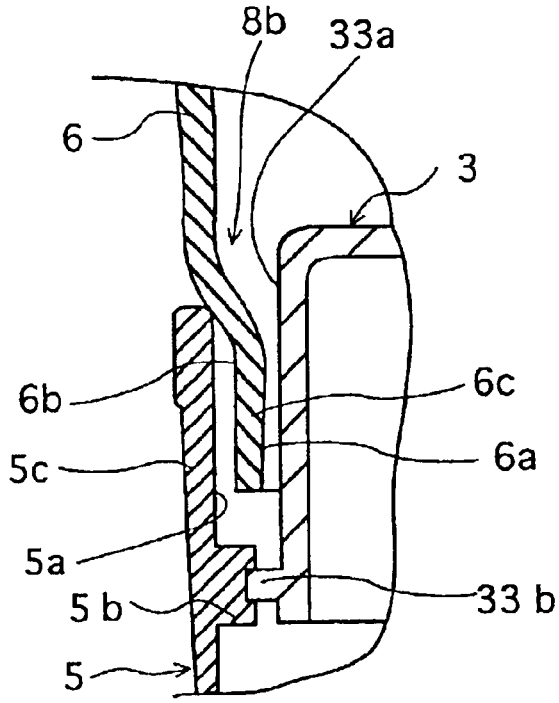
FIG. 6B is an enlarged, sectional view taken along a line passing tough the overlapping portion where the globe and the case are not bonded together.

FIGS. 6A and 6B are enlarged views each showing a portion of the fluorescent lamp where the globe 6 is loosely inserted into the case 5 (hereinafter also referred to as an overlapping portion). FIG. 6A shows an overlapping portion at which the case 5 and the globe 6 are bonded together with the adhesive 14, whereas FIG. 6B shows an overlapping portion at which the case 5 and the globe 6 are not bonded together.

As shown in FIG. 6A, the open end portion 6*c* of the globe 6 is inserted into the open end portion 5*c* of the case 5 in a manner that there is a circumferential clearance between the outer surface of the circumferential wall 33 and the inner surface of the open end portion 5*c*. In this condition, the globe 6 and the case 5 are fixed to each other with the adhesive 14. To be more specific, the globe 6 is fixed to the holder 3 with the adhesive 14 present between an inner surface 6*a* of the open end portion 6*c* and an outer surface 33*a* of the circumferential wall 33, whereas the globe 6 is fixed to the case 5 with the adhesive 14 present between an outer surface 6*b* of the open end portion 6*c* and an inner surface 5*a* of the open end portion 5*c*.

As shown in FIG. 6B, aside from bonded portions 8*a* of the overlapping portion of the globe 6 and the case 5, there are clearances 8*b* between the open end portion 6*c* of the globe 6 and the circumferential wall 33 of the holder 3 as well as between the open end portion 6*c* of the globe 6 and the open end portion 5*c* of the case 5.

The case 5 is provided with catchment members 15 formed on the inner surface 5*a* of the open end portion 5*c*. Each catchment member 15 is located at a position where the adhesive 14 is to be supplied. In other words, in the present embodiment, there are four catchment members 15 on the inner surface 5*a* at equal circumferential intervals. As shown in FIGS. 5 and 6, each catchment member 15 inwardly protrudes from the inner surface of the case 5. Yet, the catchment member 15 is not limited to the above described shape, and any other shape may be applicable as long as the catchment member 15 serves to prevent the adhesive 14 from flowing any further. For example, ribs extending in the axial direction (vertical direction) for reinforcing the case5 maybe used to catchment the adhesive 14 at the top thereof.

When Sa denotes a total area of the bonded portions (the bonded portion 8*a* in FIG. 6A) where the open end portion 6*c* of the globe 6 and the open end portion 5*c* of the case 5 are bonded to each other, and S denotes an area of the overlapping portion of the globe 6 and the case 5, the following relation is satisfied.

$$S/6 \leqq Sa \leqq S/2$$

The reason for the relation is described later.

In the present embodiment, the open end portion 6*c* of the globe 6 has an outer diameter of 42 mm. The globe 6 is loosely inserted into the case 5 so that the overlapping portion has a width of 7 mm in the vertical direction, and the area S of the overlapping portion is 923.6 $mm^2$. Further, the size of each bonded portion 8*a* is about 9.5 mm in the circumferential direction, and about 6 mm in the vertical direction. Thus, the total area Sa of the four bonded portions 8*a* is 228 $mm^2$, which is about one quarter (¼) of the area S of the overlapping portion.

The area of the bonded portion 8*a* is regulated by supplying the adhesive 14 in the amount of three grams to each bonded proton 8*a*. Thus, the areas of each bonded portion 8*a* vary to some extent, yet the above relation is still satisfied. The open end portion 5*c* of the case 5 to which the globe 6 is inserted has an inner diameter of 44 mm.

2. Test Results 2-1. Relation Between Total Area of Bonded Portions and Surrounding Temperature of Lighting Circuit With the bulb-type fluorescent lamps 1 each having the construction as above, tests were conducted to measure surrounding temperatures of the lighting circuit 4 in the case 5 in relation to the total area Sa of the bonded portions of the case 5 and the globe 6.

Used in the tests were six bulb-type fluorescent lamps 1 of which total areas Sa of the bonded portions 8*a* are, 1/1, 2/3, ½, ¼, 1/6, and ⅛, respectively of the area S of the overlapping portion. The arc tubes used in the tests were of a 100 V/13 W type. In the tests, the above six bulb-type fluorescent lamps were illuminated in an atmosphere of room temperature (25° C.) in a base-up position (in the state where the base 7 was positioned at the top). After two hours of illumination, the surrounding temperature of the lighting circuit 4 was measured for each fluorescent lamp.

Figure 7:
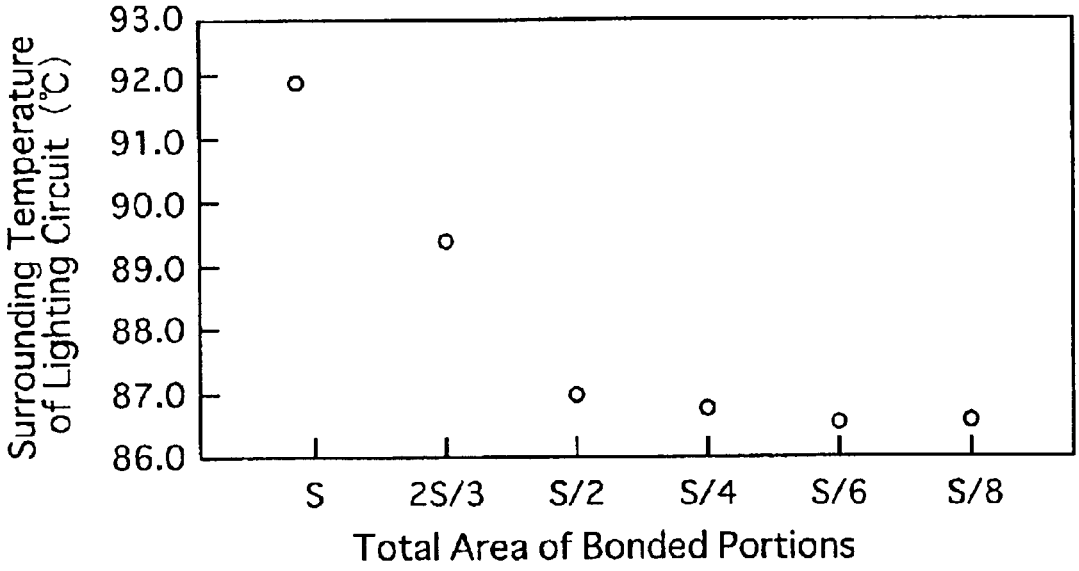
FIG. 7 is a view showing relation between temperatures of a portion surrounding a lighting circuit in relation to a total area of bonded portions where the globe and the case are bonded to each other.

FIG. 7 shows the test results. As apparent from the figure, there was a relation as follows between the total area 8*a* of the bonded portions 8*a* and the surrounding temperature of the lighting circuit 4. That is, the smaller the total area Sa of the bonded portions 8*a* was, the lower the surrounding temperature of the lighting circuit 4 was. Also, when comparing the fluorescent lamps of which total area Sa of the bonded portions 8*a* were 1/1, 2/3, ½, respectively of the area S of the overlapping portion, the surrounding temperature of the lighting circuit 4 was significantly lower. However, the surrounding temperature of the lighting circuit 4 was almost the same at about 87° C. when comparing the fluorescent lamps of which total area Sa of the bonded portions 8*a* was ½ or smaller of the area S of the overlapping portion.

Accordingly, when the total area Sa of the bonded portions 8*a* was one half (½) or smaller of the area S of the overlapping portion, the surrounding temperature of the lighting circuit 4 was lower by 5° C. or so in comparison with when the total area Sa was 1/1 of the area S of the bonded portions 8*a*, i.e., when the globe was fixed to the case with the adhesive along the entire periphery of the respective open end portions as in the conventional technique.

2-2. Relation Between Total Area of Bonded Portions and Bonding Strength

With the bulb-type fluorescent lamps 1 each having the construction as above, tests were conducted to measure strength of the bonding between the case 5 and the globe 6 in relation to the total area Sa of the bonded portions 8*a*. Used in the tests were five bulb-type fluorescent lamps 1 of which total areas Sa of the bonded portions 8*a* were, 1/1, ½, ¼, 1/6, and ⅛, respectively of the area S of the overlapping portion.

The bonded portions 8*a* were located at four circumferentially spaced locations. The tests were conducted in an atmosphere of room temperature (25° C.). In the tests, each of the above five bulb-type fluorescent lamps was subjected to a tensile load pulling the case 5 and the globe 6 in axial outward directions (the vertical direction in the figure) in order to measure the load causing the globe 6 to be detached from the case 5. The bulb-type fluorescent lamps of the present invention aim to achieve the bonding strength (tensile stress) of 20 kgf, so that tests were completed when the target bonding strength was achieved.

Figure 8:
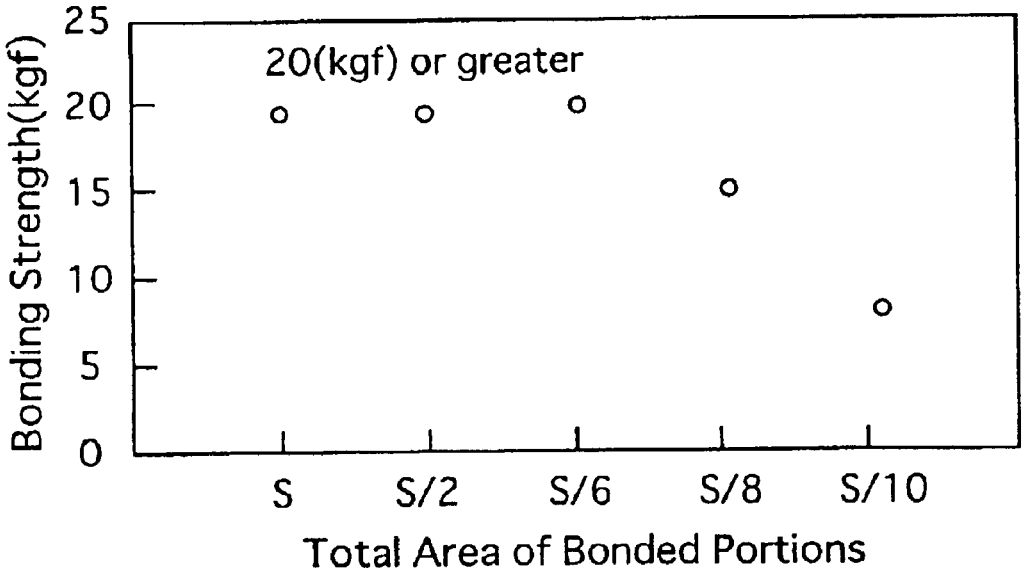
FIG. 8 is a view showing bonding strength of the bonding between the globe and the case in relation to the total area of the bonded portions.

FIG. 8 shows the test results. As apparent from the figure, there was a relation as follows between the total area 8*a* of the bonded portions 8*a* and the bonding strength. That is, when the total area Sa of the bonded portions 8*a* was ⅛ or smaller of the area S of the overlapping portion, the bonding strength decreased to 15 kgf or less, thereby failing to achieve the target bonding strength of 20 kgf. On the other hand, when the total area Sa of the bonded portions 8*a* was ⅙ or larger of the area S of the overlapping portion, the target bonding strength of 20 kgf was achieved.

It is assumed that when the total area Sa of the bonded portions 8*a* was ⅛ or smaller of the area S of the overlapping portion, the bonded area was too small to achieve the target bonding strength of 20 kgf. According to the test results, it is apparent that the target bonding strength is achieved when the total area Sa of the bonded portions is ⅙ or larger of the area S of the overlapping portion.

2-3. Relation Between Total Number of Bonded Portion and Bonding Strength

With the bulb-type fluorescent lamps 1 each having the construction as above, tests were conducted to measure strength of the bonding between the case 5 and the globe 6 in relation to the total number of the bonded portions 8*a*. Used in the tests were five bulb-type fluorescent lamps 1 respectively having one, two, three, four, and eight bonded portions 8*a*. Each of the five fluorescent lamps was so constricted that the total area of the bonded portions 8*a* was one sixth (⅙) of the area S of the overlapping portion.

Similarly to the above bonding strength tests, the tests were conducted in an atmosphere of room temperature (25° C.) by subjecting each of the above five bulb-type fluorescent lamps to a tensile stress pulling the case 5 and the globe 6 in axial outward directions. The tests were also completed when the target bonding strength of 20 kgf was achieved.

Figure 9:
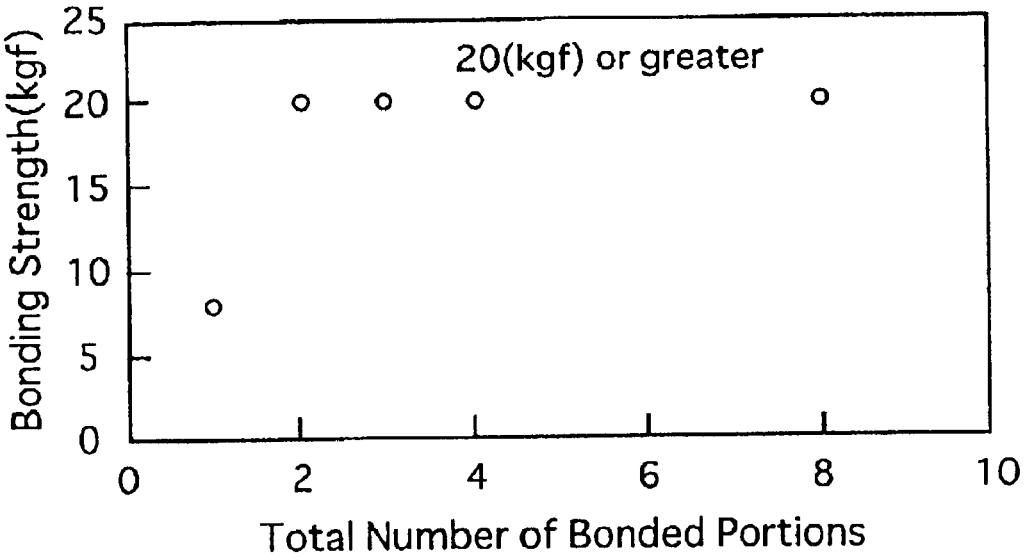
FIG. 9 is a view showing bonding strength of the bonding between the globe and the case in relation to the total number of the bonded portions.

FIG. 9 shows the test results. As apparent from the figure, there was a relation as follows between the number of the bonded portions 8*a* and the bonding strength. That is, when the case and the globe 6 were bonded at two or more bonded portions, the target bonding strength of 20 kgf was achieved.

It is assumed that when there was only one bonded portion 8*a* provided between the case 5 and the globe 6, the globe 6 would be easily inclined or twisted relative to the case 5, so that shearing stress was applied to the adhesive 14 in addition to tensile stress. Accordingly, the target strength 20 kgf of the bond between the globe 6 and the case 5 is achieved when two or more bonded portions are provided at equal intervals.

2-4. Recapitulation

According to the tests described in the above 2-1 chapter, it is made clear that the surrounding temperature of the lighting circuit 4 stays substantially constant when the total area Sa of the bonded portions 8*a* is one half (½) or smaller of the area S of the overlapping portion. That is to say, the rise in the surrounding temperature is suppressed under the above condition. Further, according to the tests described in the above 2-2 and 2-3 chapters, it is made clear that the target bonding strength is achieved when the total area Sa of the bonded portions 8*a* are one sixth (⅙) or larger of the area S of the overlapping portion, and two or more bonded portions 8*a* are provided.

In view of the above, when the total area Sa of the bonded portions falls in a range from one sixth (⅙) to one half (½) of the area S of the overlapping portion, temperature rise in the lighting circuit 4 is suppressed while achieving high bonding strength.

3. Method for Fixing Globe to Case

Now, description is given to a method for manufacturing the bulb-type fluorescent lamp 1 having the construction described above.

Figure 10C:
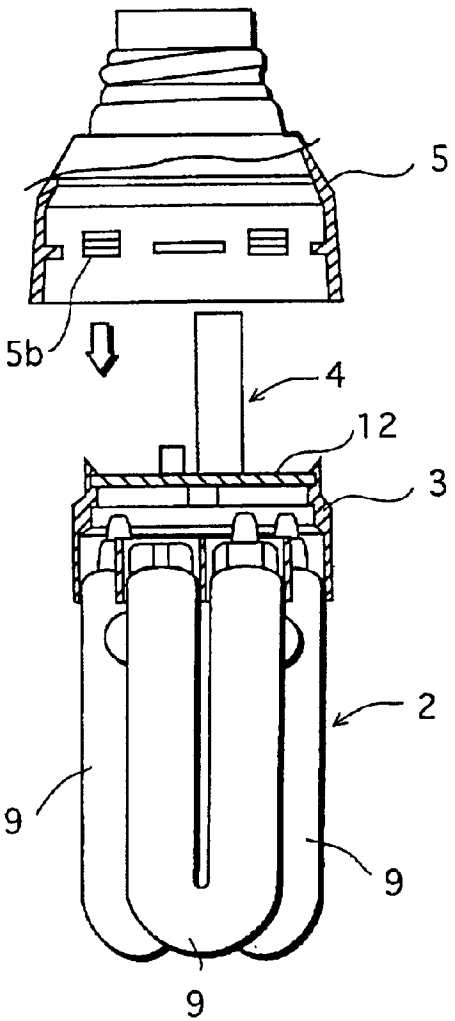
FIGS. 10A–10C are schematic views showing a method for manufacturing the bulb-type fluorescent lamp according to the embodiment of the present invention.
Figure 10B:
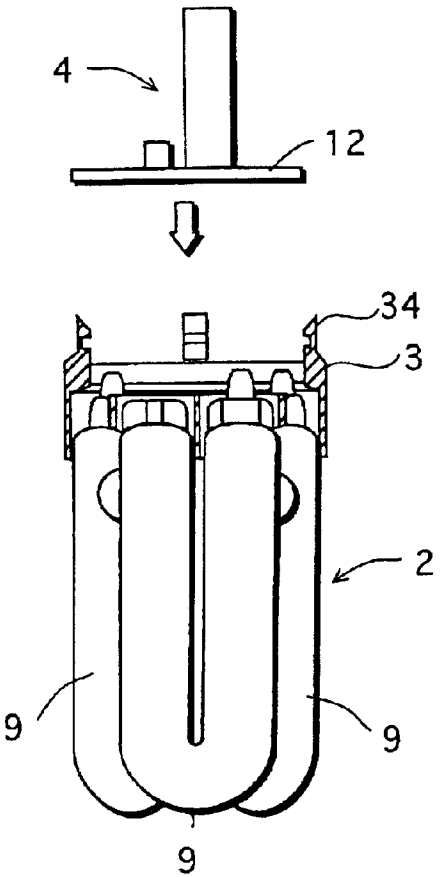
Figure 10A:
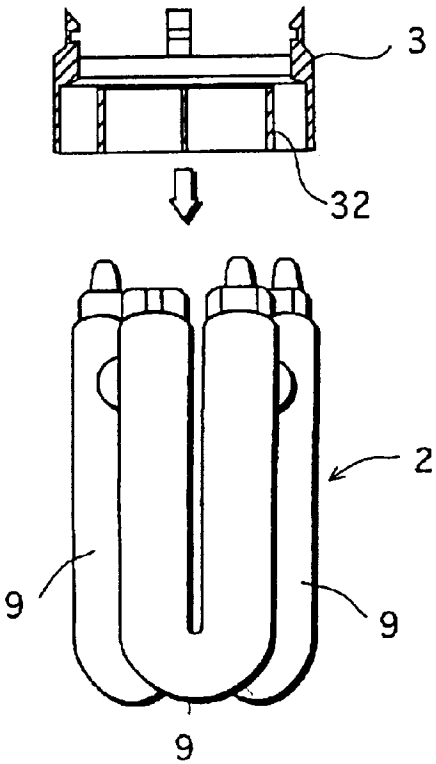

First, as shown in FIG. 10A, the arc tube 2 composed of the three bulbs 9 is held in a position with its ends at the top, and holder 3 is attached to the arc tube 2 in a manner that each supporting member 32 provided on the holder 3 fits around each end of the bulbs 9.

Next, as shown in FIG. 10B, the substrate 12 onto which the lighting circuit 4 is provided is brought into engagement from above against each latching arm 34. By further pressing the substrate 12 downward, the substrate 12 is latched by the latching arms 34 of the holder 3, whereby a process for attaching the substrate 12 to the holder 3 is completed.

Next, as shown in FIG. 10C, the case 5 is pressed down to bring the engaging member 5*b* of the case 5 into engagement with the protrusions of the holder 3, whereby the case 5 is attached to the holder 3. Thereafter, the base 7 is mounted on the case 5 in a manner to cover the top portion of the case 5. The case 5 to which the arc tube 2, the substrate 12, the base 7, and other components are attached is then turned upside down, and held in a position with the open end of the case 5 at the top as shown in FIG. 11A.

Figures 11A, 11B, 11C:
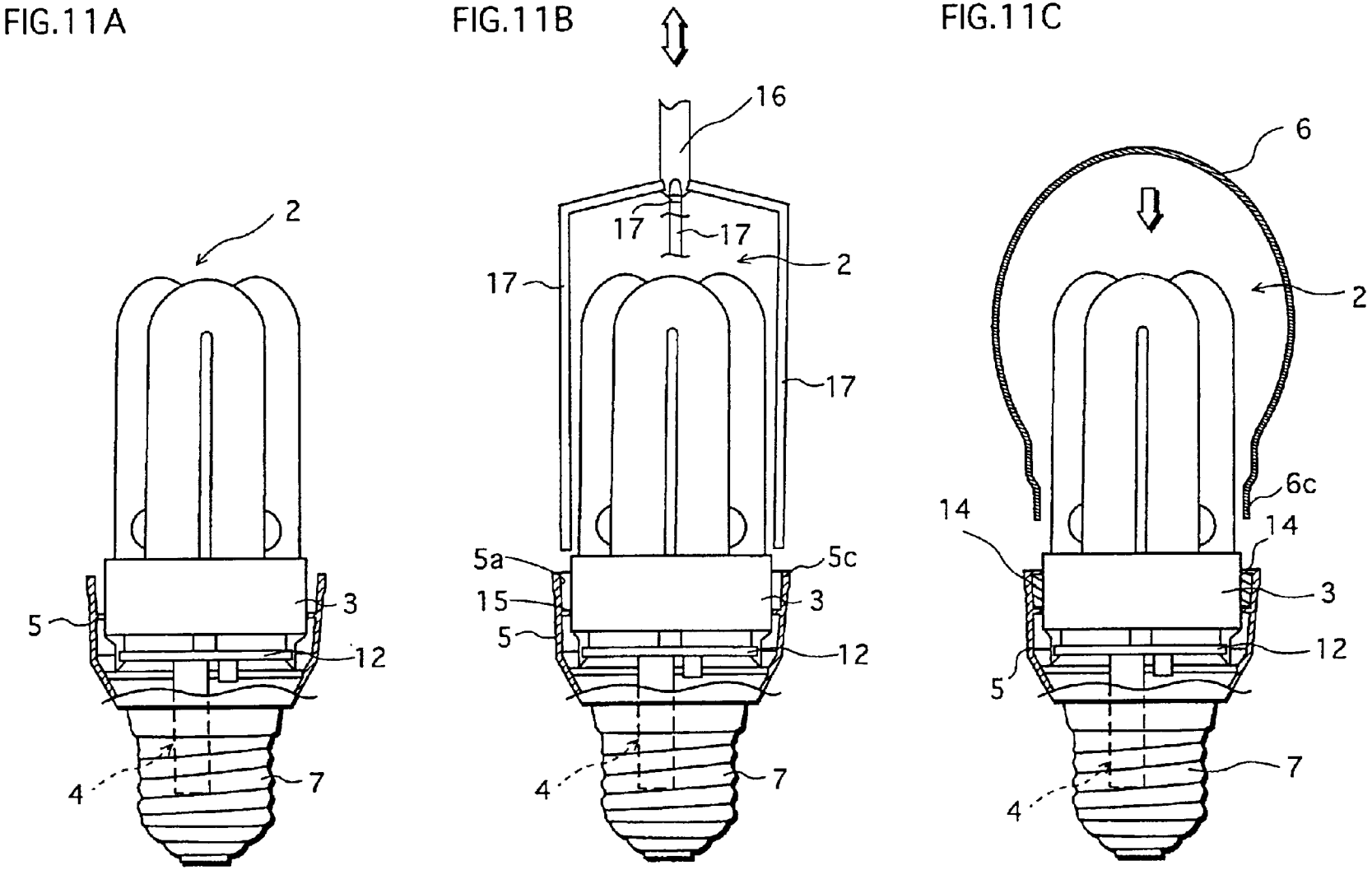
FIGS. 11A–11C are schematic views showing the method for manufacturing the bulb-type fluorescent lamp according to the embodiment of the present invention.

Next, as shown in FIG. 11B, the adhesive is supplied through supply nozzles 17 to the positions corresponding to where the catchment members 15 on the inner surface 5*a* of the case 5 are located. Correspondingly to the catchment members 15, there are four supply nozzles 17 branching off from an end of a supply tube 16. Through the supply nozzles 17, the adhesive 14 is supplied between the circumferential wall (33) of the holder 3 and the inner surface 5*a* of the open end portion 5*c* of the case 5 at four positions above the catchment members 15. Here, three grams of the adhesive 14 is supplied to each of the four positions substantially simultaneously.

With the adhesive 14 present between the circumferential wall of the holder 3 and the inner surface 5*a* of the open end portion 5*c* of the case 5, the open end portion 6*c* of the globe 6 is inserted into the open end portion 5*c* of the case 5 as shown in FIG. 11*c*. In this condition, the adhesive 14 is subjected to heat curing (for 15 minutes at 120° C.), thereby fixing the case 5 to the globe 6.

According to the above method, the adhesive 14 is supplied to a plurality of positions substantially simultaneously. Therefore, time taken to supply the adhesive is significantly shortened in comparing with time taken in the conventional method in which the case needs to be rotated in order to supply the adhesive along the entire periphery of the case.

Further, there is no need to rotate the case, the above method prevents a conventional problem of splattering of the adhesive that may occur at the time of rotating the case. Thus, the adhesive is supplied in the predetermined amount with ease and stability. Consequently, the usage amount of the adhesive 14 is reduced, which leads to reduction in the manufacturing cost as well as improvement in the productivity.

Still further, in the conventional method, at the time of inserting the globe into the case, the adhesive present between the globe and the case is squeezed out of the case. According to the present embodiment, however, there is a space on the both sides of where the adhesive 14 is supplied. Consequently, at the time of inserting the case 5 into the globe 6, the adhesive 14 present between the case 5 and the globe 6 flows into the space on the both sides, so that the adhesive 14 is kept from flowing out over the outer surface of the case 5 (on the side of the outer surface of the globe 6).

Modifications

Up to this point, the present invention is described by way of the embodiment. However, it is naturally understood that the present invention is in no way limited to the specific embodiment described above, and modifications such as the following may be made.

(1) Types of Discharge Lamp

In the above embodiment, the arc tube 2 is of a so-called triple U-shaped arc tube 2 that is made of the three U-shaped bulbs 9. Yet, other types of arc tubes are applicable as well. One example is a dual U-shaped arc tube that is made of two of the U-shaped bulbs 9 used in the above embodiment.

Further, the shape of the globe is not limited to the pear-shape (A-shape) used in the above embodiment, and any other shape conforming to the shape of the arc tube may be applicable. Examples include a circular shape (C-shape) for an annular arc tube, a tubular shape (T-shape) and a globe shape (G-shape) both for a dual U-shaped arc tube.

Still further, in the above embodiment, the inner surface of the arc tube is coated with a phosphor for causing visible radiation. Yet, other types of arc tubes are applicable as well. One example is a type of arc tube, such as a black light lamp, that emits light by ultraviolet radiation.

(2) Fitting of Case and Globe

In the above embodiment, the open end portion 6*c* of the globe 6 is inserted between the circumferential wall 33 of the holder 3 and the open end portion 5*c* of the case 5, whereby the globe 6 is fixed to the case 5 with the adhesive 14. Instead, the globe 6 may be fixed to the outer surface of the case 5.

In this case, the adhesive 14 is supplied to the inner circumferential surface of the open end portion 6*c* of the globe 6. Then, the open end portion 6*c* of the globe 6 is fitted around the open end portion 5*c* of the case 5.

Note that in the above embodiment, the area S of the overlapping portion refers to the area of the globe 6 overlapping the case 5. This applies to the situation where the open end portion 6*c* of globe 6 is inserted into the case 5. In the situation where the open end portion 5*c* of the case 5 is inserted into the globe 6, i.e., where the open end portion 6*c* of the case 6 is located outermost, the area S of the overlapping portion refers to the area of the case 5 overlapping the glob 6. Naturally, in the situation where the case 5 is inserted into the globe 6, the total area Sa refers the sum of the areas of the case 6 that are bonded to the globe 6.

Still further, in the above embodiment, both the case 5 and the globe 6 have open ends that are circular in cross section. Yet, the open ends of the case 5 and the globe 6 may be in any other shape in cross section. Examples include open ends that are polygonal or oval in cross section. Note that, however, the two open ends need to have shapes conforming to each other so as to achieve proper fitting.

(3) Positions of Bonding Between Globe and Case

In the above embodiment, the case 5 and the globe 6 are fixed to each other at four portions that are circumferentially and equally spaced. Yet, the number of the bonded portions is not limited to four as long as there are at least two, circumferentially spaced bonded portions for the reasons described in the above chapter of 2–3. In view of the bonding strength, a greater number of bonded portions are preferable. In contras, a fewer number of bonded portions are preferable in view of the heat conductivity. Considering both the bonding strength and the heat conductivity, provision of three or four bonded portions 8*a* is considered to be appropriate when embodying the present invention.

(4) Sticking Agent

In the above embodiment, the adhesive 14 is used as an sticking agent to fix the globe 6 to the case 5 at the open end portions 6*c* and 5*c*, respectively. However, any other types of sticking agent may be used instead of the adhesive 14. One example is a sealing agent such as a silicon resin. The sealing agent is used in the similar manner to the adhesive 14. That is, the sealing agent is supplied through the supply nozzles 17 onto the inner surface of the open end portion 5*c* of the case 5, and then the open end portion 6*c* of the globe 6 is loosely fitted into the open end portion 5*c* of the case 5, followed by curing of the sealing agent. In this way, the globe 6 is fixed to the case 5.

(5) Supply Nozzles

In the above embodiment, the four supply nozzles 17 branch off from an end of the supply tube 16. Yet, the number of the supply nozzles 17 is not limited to four as long as there are plural supply nozzles 17. For example, two supply nozzles 17 that are bifurcated from the supply tube 16 may be used. In this case, the adhesive 14 is supplied to four locations in two times, first to two locations, then to another two locations after the supply nozzles 17 or the case 5 is rotated. Even in this case, time taken to supply the adhesive is still shortened to some extent in comparison with time taken in the convention method in which the case must be rotated one full turn.

Further, in the above embodiment, each supply nozzle 17 is circular in cross section. Yet, each supply nozzle may have a flat cross section that curves in a manner conforming to the inner periphery of the open end of the case 5. With this flat cross section, the adhesive may be supplied along the inner surface of the case 5. Thus, even when supplying the adhesive by rotating the case 5 or the supply nozzles 17, the required rotation angle is made smaller. Consequently, the adhesive 14 is efficiently supplied to the open end portion 5*c* of the case 5.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A low-pressure mercury vapor discharge lamp comprising:

an envelope formed of a case and a globe each having an open end, the case and the globe being loosely fitted together by inserting one open end into the other;

an arc tube covered by the globe; and a lighting circuit housed in the case, wherein the case and the globe are partially bonded to each other along a circumferential surface of where the case and the globe overlap as the result of insertion, so that an area surrounding the lighting circuit is in communication with an area exterior of the envelope.

2. The low-pressure mercury vapor lamp of claim 1, wherein the case and the globe are bonded to each other at a plurality of circumferentially spaced areas of the overlapping surface.

3. The low-pressure mercury vapor lamp of claim 2, wherein the case and the globe are bonded to each other at the plurality of areas with a sticking agent.

4. The low-pressure mercury vapor lamp of claim 2, wherein the plurality of areas are equally and circumferentially spaced.

5. The low-pressure mercury vapor lamp of claim 3, wherein the case is provided with a catchment member formed on an inner surface of the open end portion, the catchment member inwardly protruding so as to catch the sticking agent.

6. The low-pressure mercury vapor lamp of claim 4, wherein an area S of the overlapping surface of the globe and a total area Sa of the areas where the globe is bonded to the case satisfies a relation expressed by $S/6 \leqq Sa \leqq S/2$.

7. The low-pressure mercury vapor lamp of claim 1, wherein the fitting is achieved by loosely inserting the open end portion of the globe into the open end portion of the case.

8. A low-pressure mercury vapor discharge lamp comprising:

a globe;

a holder member;

an arc tube mounted on one side of the holder member and extending into the globe;

a lighting circuit mounted on another side of the holder member; and a case housing the lighting circuit, wherein the case and the globe are partially bonded to each other along overlapping circumferential surfaces, so that an area surrounding the lighting circuit is in communication with an area exterior of the globe.

9. The low-pressure mercury vapor lamp of claim 8, wherein the case and the globe are bonded to each other at a plurality of circumferentially spaced areas of the overlapping surfaces.

10. The low-pressure mercury vapor lamp of claim 9, wherein the case and the globe are bonded to each other at a plurality of areas with an adhesive material.

11. The low-pressure mercury vapor lamp of claim 8 wherein the globe has a recessed neck portion and is supported by the case above the recessed neck portion so that an open end of the globe is offset from an annular wall of the case and an annual wall of the holder member.

12. The low-pressure mercury vapor lamp of claim 11 wherein the recessed neck portion is surrounded by adhesive material.

13. The low-pressure mercury lamp of claim 12 wherein the globe is a synthetic resin and the adhesive material is a heat-resistant silicon adhesive.

14. A low-pressure mercury vapor discharge lamp comprising:

a bulb having an open end;

a housing defining a cavity and having an open end that is partially attached along a circumferential surface to the open end of the bulb so that air within the cavity can travel to an area located outside the bulb;

a lighting circuit positioned within the cavity; and an arc tube connected to the lighting circuit and extending outside the cavity of the housing and into the bulb.

15. The low-pressure mercury vapor lamp of claim 14, wherein the bulb and the housing are attached to each other at a plurality of areas.

16. The low-pressure mercury vapor lamp of claim 15, wherein the plurality of areas are equally and circumferentially spaced apart.

17. The low-pressure mercury vapor lamp of claim 15, wherein the bulb and the housing are bonded to each other at the plurality of areas using an adhesive material.

* * * * *